US005243507A

United States Patent [19]

Atkins et al.

[11] Patent Number: 5,243,507

[45] Date of Patent: Sep. 7, 1993

[54] PORTABLE QUARTZ FLOODLIGHT FIXTURE

[76] Inventors: Donald W. Atkins, 1401 Shamrock Dr., Burlington, N.C. 27215; C. L. Chen, 4F-11, 207 Tun-Hwa N. Road, Taipei, Taiwan

[21] Appl. No.: 919,824

[22] Filed: Jul. 27, 1992

[51] Int. Cl.[5] ..... F21L 1/00

[52] U.S. Cl. ..... 362/376; 362/269; 362/310; 362/374; 362/400; 362/455

[58] Field of Search ..... 362/269, 310, 311, 374, 362/375, 376, 399, 455, 400

[56] References Cited

U.S. PATENT DOCUMENTS 1,625,693 4/1927 Vest ..... 362/455

4,410,931 10/1983 DeCandia et al. ..... 362/455

*Primary Examiner*—Richard R. Cole

*Assistant Examiner*—L. Heyman

*Attorney, Agent, or Firm*—Rhodes, Coats & Bennett

[57] ABSTRACT

A fixture for portable quartz floodlights in which a plurality of clips are secured to the periphery of the housing. A portion of each clip overlies the safety guard and lens to press the guard and lens into assembled relationship with a peripheral flange which extends around the housing. A handle is attached to the housing at the top center to facilitate transportation of the fixture.

4 Claims, 2 Drawing Sheets

PORTABLE QUARTZ FLOODLIGHT FIXTURE

BACKGROUND AND SUMMARY OF THE INVENTION

The present invention is directed to portable quartz floodlights, and more specifically to a frameless fixture for such floodlights which eliminates the expensive conventional frame casting that holds the wire guard and lens to the housing.

Portable quartz floodlights have become extremely popular to consumers in recent years. Such floodlights enable a consumer to extend the daylight activities with a portable source of light. Thus, these quartz floodlights have been found useful for recreational purposes such as camping, boating, entertaining, and sports such as volleyball and basketball; as a spotlight for decorating homes during holidays; for construction purposes such as painting, cleaning gutters, building decks, installing doors and windows, or pouring cement at night; or for emergency situations such as automotive problems, frozen pipes, and the like.

Portable quartz floodlights, presently available in the marketplace, generally include a stand for supporting the lamp housing on some horizontal surface, a rather large handle formed as an extension of the stand for carrying the lamp from place to place, and a lamp housing. The lamp housing generally includes a top wall, bottom wall, side walls, and a rear wall which support a reflector therein having a generally rectangular open front. A quartz lamp is mounted within the housing at the base of the reflector and is connected to an electrical source. The front opening is closed by a transparent glass lens. Because of the tremendous heat generated by the quartz lamp, a safety guard is provided across the lens. The safety guard is generally a plurality of curved wires connected to some type of frame, and the wires extend across the lens. As a result, if the lamp tips over forwardly, the wires keep the hot lens from contacted anything that might be flammable. Also the wires prevent a user's fingers from contacting the glass lens which is extremely hot. reduction if a substitute means for attaching the guard and lens were developed.

In the present invention, the frame is eliminated to provide a frameless portable quartz fixture. The function of the frame has been replaced by a plurality of rather simple clips which overlie the edge portion of the lens and the frame portion of the wire guard to retain them in tightly assembled relationship to the housing. To accomplish this result, a forwardly projecting lip is added to the housing flange, and the flange is provided with a plurality of outwardly protruding ears. The aforesaid clips are so constructed to overlie the frame of the wire guard and edge of the lens. Each clip is secured to one of the ears to secure it in place. In a preferred embodiment, the means for retaining the clip in gripping relation to the wire guard and lens is a boss cast in the surface of each ear which includes a threaded opening to receive a fastener. Obviously, other retaining means could be provided.

A second cost-reducing improvement to the portable fixture is a change in the handle construction. Rather than the handle being an extension of the support frame, the handle in the present invention has been simplified in the form of an L-shaped member which is secured to a tab or protuberance on the top of the fixture housing. This handle is much simpler, easier to manufacture, and results in a more economical cost, while providing the same function of transporting the fixture from place to place.

It is therefore an object of the present invention to provide improvements in portable quartz floodlights.

It is another object of the present invention to improve portable quartz floodlights by eliminating the frame casting which has been used to secure the wire guard and lens to the front of the housing.

It is yet another object of the present invention to provide a portable quartz floodlight with a plurality of clips which are used to secure the frame and lens to the front of the housing.

Still another object of the present invention is to provide a portable quartz floodlight of the type described in which the large bulky handle is replaced by a simple handle member attached directly to the fixture housing.

Other objects and a fuller understanding of the invention will become apparent from reading the following detailed description of a preferred embodiment in conjunction with the drawings.

DETAILED DSCRIPTION OF A PREFERRED EMBODIMENT

Figure 1:
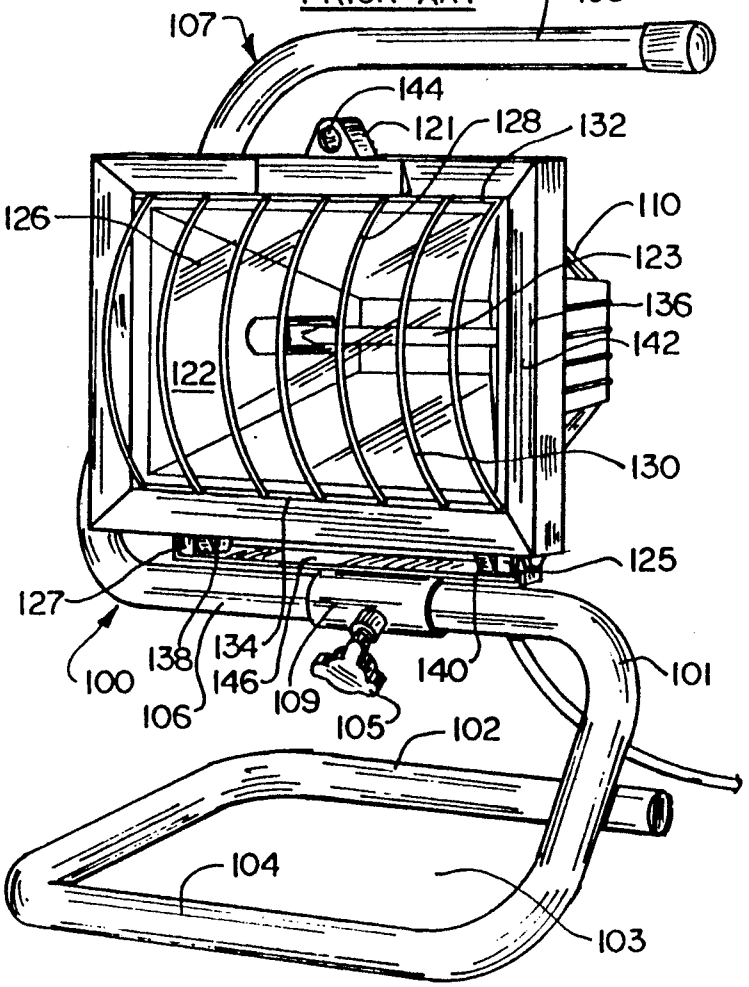
FIG. 1 PRIOR ART
FIG. 1 is a front perspective view of a portable quartz floodlight as constructed previously.

Turning now to the drawings, there is illustrated in FIG. 1 a conventional portable quartz floodlight of the type presently available in the market. The floodlight of FIG. 1 includes generally a stand/handle assembly 100, a lamp housing 110 and hinged frame 136.

The stand/handle assembly 100 includes a first stand member 103 formed of a continuous tubular member 101. The tubular member 101 commences with a rear leg 102 which curves around to a horizontally spaced parallel front leg 104, then continues up to a vertically spaced, horizontally extending mounting rod 106. The stand/handle assembly also includes a second handle member 107 formed of a second tubular member. The upper extremity of the tubular member is the handle 108, which curves around and terminates in a separate tubular section 109 welded to member 107 and that telescopes onto the mounting rod 106. A set screw 105, when loosened, allows the tubular section 109 to rotate around the mounting rod 106 for angular adjustment of the housing. When the correct angle is determined, the set screw 105 is tightened which prevents further rotation of tubular section 109 with respect to mounting rod 106. As can be seen, the second handle section 107 requires a considerable length of tubing which must undergo forming and the provision of a separate telescoping portion welded to the handle and set screw to accomplish the angular adjustment. Thus, the handle member 107 is a relatively expensive component of the portable quartz fixture of FIG. 1.

The lamp housing 110 is a cast member which includes upper and lower walls and end walls closed at the rear by a rear wall. The side walls, top wall and bottom wall frame an opening through which light escapes. A reflector 122 is placed within the housing and a lamp 123 is secured at the base of the housing 110 and connected to a suitable electrical source. An outwardly extending peripheral flange extends around the periphery of the housing edge formed by the top wall, bottom wall, and side walls. The tempered glass lens 126 covers the opening and a wire safety guard 128 is provided atop the glass lens 126 to protect both the user and any object which comes in contact with the glass from the extensive heat achieved on the surface of the glass lens 126. The wire safety guard 128 is formed of a plurality of wire grid members 130 which are supported between upper and lower support rods 132,134. The support rods 132,134 extend outwardly from the end portions thereof and, along with the glass lens 126, are retained beneath the hinged frame 136 which is to be described hereinbelow.

Hinged frame 136, when assembled, is moved into gripping relationship with the ends of the support rods 132,134 and around the peripheral edge of the lens 126. The frame 136 then secures the wire safety guard 128 and the lens to the peripheral flange of housing 110. The hinged frame 136 includes a rectangular frame member 142 having a pair of hinge plates 138,140 extending from the lower edge thereof and an attachment lug 144 protruding upwardly from the top edge thereof. As designed, the hinged frame with the frame member 142 including hinge plates 138,140 and attachment lug 144 is also a cast member which requires a die and is thus a significant element of expense.

The hinge plates 138,140 are hingedly attached to a pair of cooperating support plates 125,127 which extend downwardly from housing 110. Further, the attachment lug 144 is selectively secured to an attachment boss 121 which protrudes upwardly from housing 110.

Finally, the assembled housing is attached to the stand/handle assembly 100 by means of a bracket 146 which is secured to the tubular section 109 and has upstanding end portions. As can be seen, there are several relatively expensive components to the aforedescribed assembly. The entire handle member 107 is one of such expenses. The primary expense, however, to be eliminated by the present invention, is the entire frame 136. This frame 136 is a separate casting and is substantially as costly as the housing 110 itself.

Figure 2:
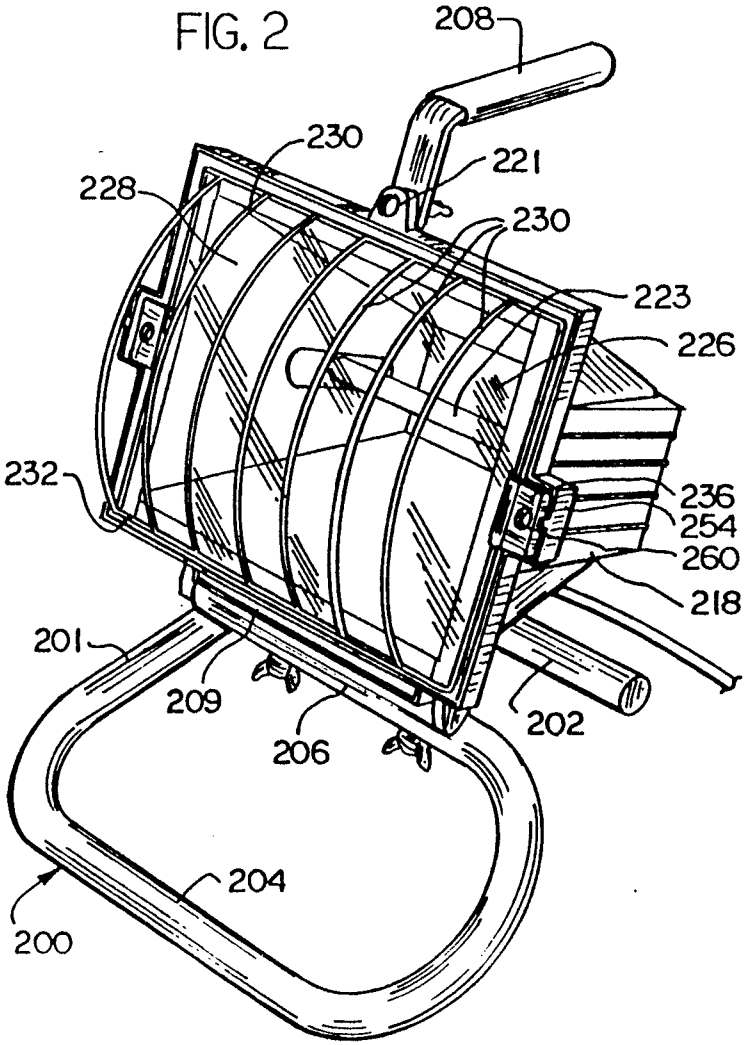
FIG. 2 is a front perspective view of a portable quartz floodlight in accordance with the present invention in its assembled form.
Figures 3, 4:
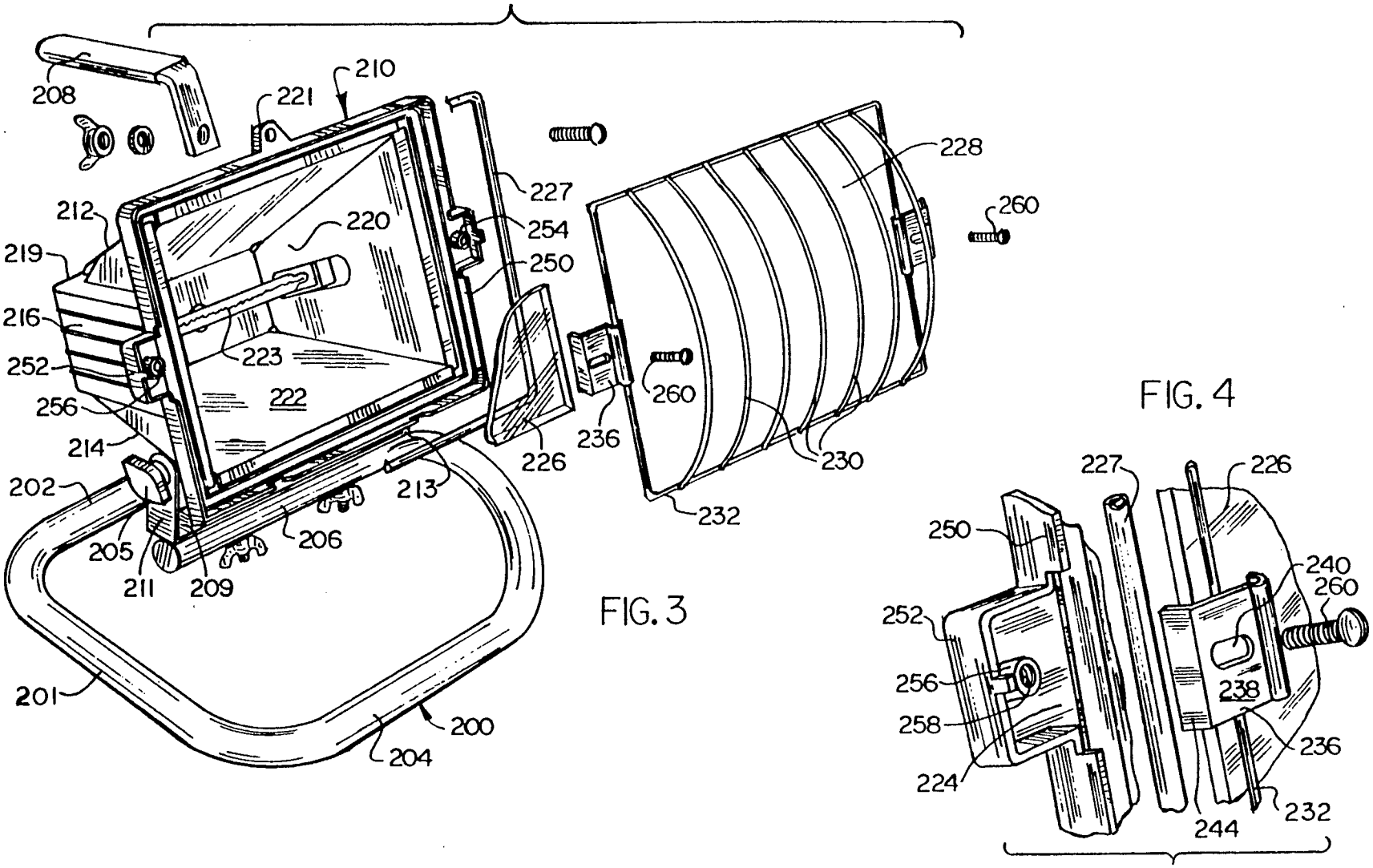
FIG. 3 is an exploded perspective view of the floodlight of FIG. 2 illustrating the wire guard, lens, and retaining clips separated from the fixture housing.
FIG. 4 is an exploded perspective view of the retaining clip and mounting portion of the floodlight of FIG. 2.

Turning now to FIGS. 2 and 3, there is illustrated the fixture according to the present invention. The fixture of the present invention also includes a stand assembly 200 in the form of a continuous tubular member 201. Stand 200 also includes spaced legs 202,204 with the tubular member 201 curving around to form a vertically spaced horizontally extending mounting rod 206. The legs 202,204 and mounting rod 206 correspond to the first stand member 103 in the embodiment of FIG. 1. It should, however, now be recognized that there is no large, bulky handle member which corresponds to the second member 107 of the first embodiment. Rather, the handle member 208 of the present invention is small and attached to the housing itself. The mounting rod 206 includes a U-shaped mounting bracket 209 having upstanding end portions 211,213 secured thereto by a plurality of fasteners.

In the present invention, housing 210 also includes top wall 212, bottom wall 214, and a pair of opposed side walls 216,218. The rear of the housing is closed by a rear wall 219. The side walls, top wall, and bottom wall frame a front opening 220 through which light is emitted. A reflector 222 is fixed within the walls of the housing 210 and again a lamp 223 is secured at the base of the housing 210 and connected to an electrical source.

Housing 210 includes a peripheral flange 224 which extends around the periphery of opening 220. However, flange 224 differs from the flange of the previous embodiment in at least two principle respects. First of all, the flange 224 includes a forwardly extending lip 250 which extends substantially around the periphery of flange 224 and with the flange forms a seat for lens 226 and depressible gasket 227. Further, the flange 224 protrudes outwardly at opposed points to form a pair of opposed mounting ears 252,254. Ears 252,254 provide for points of attachment for mounting clips 236 which will be described hereinbelow. Each ear 252,254 includes a boss 256 molded into the surface thereof, and a threaded opening 258 therein.

Again, housing 210 is provided with a flat transparent lens member 226 and an overlying safety guard 228. Safety guard 228 is similar to safety guard 128 in that it includes a plurality of wire grid members 230, however, it differs from wire guard 128 in that the wire grid members 230 are secured to opposite sides of a rectangular frame member 232 rather than to merely a pair of spaced support rods 132,134. Thus, the wire frame 232 extends around the periphery of the guard 228, rather than merely across the top and bottom. This is important as will be described hereinbelow.

Housing 210 also includes an attachment boss or lug 221 at the top thereof to which a simple L-shaped handle 208 is secured. Thus, the relatively simple handle 208 replaces the massive handle member of the previous embodiment and is simply secured to a boss 221 at the top of housing 210.

Housing 210 also includes mounting lugs 225,227 which extend downwardly from the lower wall thereof to provide a connection point between the upstanding ends 211,213 of the mounting bracket 209. Adjustment screws 205 then adjustably secure the housing 210 to the stand 200, so that the housing may be angularly adjusted to direct the light in any desired direction.

In the embodiment illustrated in FIGS. 2 and 3, the hinged frame 136 of the previous embodiment has been eliminated and replaced by a plurality of clips 236, each of which is so designed as to be attachable to one of the ears 252,254 and to overlie a section of the safety guard frame 228 and the peripheral portion of lens 226. It should be noted that the ears 252,254 each include a boss 256 upstanding from the surface thereof. The boss 256 includes a threaded opening 258 therein.

Each clip includes a flat plate portion 238 having an opening 240 therein. An arcuate lip portion 242 extends along one edge of the plate portion 238 and overlies a section of the frame 232 of the safety guard 228. The arcuate portion 242 is preferably secured (as by welding) to the wire frame, however, securement of the clip to the frame is not critical. A downturned edge segment 244 extends along the opposite side from arcuate portion 242. To assemble the clip 236, the glass lens 226 is placed on a sealing gasket 227 within the recess formed by the lip 250 and flange 224 of housing 210. The wire guard 228 is then placed on the lens 226 so that each of the clips 236 is aligned with one of the ears 252,254. The openings 240 should then align with the threaded openings 258 within bosses 256.

A fastener 260 is then placed in each of openings 240 and the clips 236 are then secured to the ears 252,254. As the fasteners 260 are tightened, the depending edges 244 are received within the lip of the peripheral flange to insure alignment.

As a result of the construction illustrated in FIGS. 2 and 3 and described hereinabove, both the large massive handle member 107 of the earlier embodiment and the expensive hinged frame are eliminated. As a result, the cost of the excessive material in the handle member 107 as well as the second, rather expensive casting for the hinged frame 136 are eliminated. Even though the frame is eliminated, the function of the frame is replaced by the two simple clips 236.

While a preferred embodiment of the present invention has been shown and described hereinabove, it is apparent that various changes and modifications might be made without departing from the scope of the invention which is set forth in the accompanying claims.

What is claimed is:

1. A frameless portable quartz floodlight of the type having a housing with top, bottom, side, and rear walls forming a substantially rectangular opening and said housing containing a quartz lamp therein, a reflector mounted within said housing, a support stand on which said housing is mounted, a front lens, wire safety guard, and a carrying handle, the improvement comprising:

a) said housing including a peripheral flange surrounding and framing said opening, said flange including a raised lip around at least a portion of the periphery thereof to form a seat therein;

b) said peripheral flange having outward projections at spaced points to form a plurality of ears;

c) said lens being so sized and shaped as to rest within said raised lip and on said flange, when assembled, said lens being sealed against said flange by a depressible gasket which extends around said opening within said raised lip between said lens and said flange;

d) said wire safety guard comprising a generally rectangular wire frame having substantially the same outer dimension as said lens and said flange and a plurality of convex wire grid members secured at the ends thereof to said wire frame and extending across said wire frame;

e) a plurality of retaining clips, each retaining clip having a first retaining portion overlying a section of said wire frame and a second attachment portion overlying one of said ears;

f) attachment means for securing said retaining clip to said ears;

g) whereby, upon assembly, said retaining clip holds the wire frame of said safety guard against said lens to retain said lens onto said peripheral flange of said housing.

2. The floodlight according to claim 1 wherein said attachment means includes a boss upstanding from the surface of each ear, a threaded opening through said boss, a cooperating opening in said clip, and a fastener means extending through said clip and into said threaded opening in said boss for securing said clip thereto.

3. The floodlight according to claim 1 wherein the portion of said clip which overlies a section of said wire frame is arcuate in shape and secured to said wire frame.

4. The floodlight according to claim 1 and further including an attachment boss extending upwardly from said top wall of said housing, an L-shaped handle, and means for attaching one end of said handle to said attachment boss.

* * * * *